United States Patent [19]

Ulferts

[11] Patent Number: 4,982,949

[45] Date of Patent: Jan. 8, 1991

[54] MERRY-GO-ROUND

[76] Inventor: Calvin Ulferts, 465 Terrace Dr., Granite Falls, Minn. 56241

[21] Appl. No.: 349,838

[22] Filed: May 10, 1989

[51] Int. Cl.[5] ..... A63G 1/32

[52] U.S. Cl. ..... 272/33 R; 272/30

[58] Field of Search ..... 272/30, 33 R, 33 B

[56] References Cited

U.S. PATENT DOCUMENTS

| | | | |
|---|---|---|---|
| 1,896,796 | 2/1933 | Lahay . | |
| 2,384,906 | 9/1945 | Franklin | 272/33 R |
| 2,405,495 | 8/1946 | Franklin | 272/33 R |
| 2,680,616 | 6/1954 | Taylor et al. . | |
| 2,689,125 | 9/1954 | Wolbert . | |
| 2,739,811 | 3/1956 | Persons . | |
| 2,835,491 | 5/1958 | Meyers . | |
| 3,172,659 | 3/1965 | Daleiden | 272/33 R |
| 3,199,868 | 8/1965 | Motyka | 272/30 |
| 3,210,075 | 10/1965 | Brookman et al. . | |
| 3,339,919 | 9/1967 | Jones . | |
| 3,758,108 | 9/1973 | Tada . | |

FOREIGN PATENT DOCUMENTS 647521 12/1950 United Kingdom .

*Primary Examiner*—Richard E. Chilcot, Jr.
*Attorney, Agent, or Firm*—Jacobson & Johnson

[57] ABSTRACT

A merry-go-round having seats for both riders and children who want to propel the merry-go-round with a pair of crank mechanism that are offset to ensure that their is no "dead spot" to make start up of the merry-go-round difficult with the merry-go-round including a pair of pivoting handles for children to propel the merry-go-round with octagonal shaped circumferential seating and foot support areas to support the children's feet above the ground and a pair of safety hand rails for riding children to hold onto and to prevent the riding children from coming in contact with the pivoting handles.

11 Claims, 3 Drawing Sheets

MERRY-GO-ROUND

FIELD OF THE INVENTION

This invention relates generally to merry-go-rounds and, more specifically to a merry-go-round propelled by the riders.

BACKGROUND OF THE INVENTION

The concept of merry-go-rounds is old in the art and generally involves a pedestal base with a revolving seating area. The riders, who sit on the seating area, propel the merry-go-round by pumping back and forth on pedals or handles. The handles connect to a central post having a crank that permits the seating area to revolve around the central post.

DESCRIPTION OF THE PRIOR ART

The 1933 Lahay U.S. Pat. No. 1,896,796 shows a merry-go-round where the riders operate levers that engage a cam to propel the merry-go-round.

The 1950 Great Britain patent No. 647,521 uses a ratchet and pawl mechanism to permit the riders to propel themselves.

The 1954 U.S. Pat. No. 2,689,125 uses a friction drive mechanism to permit the riders to propel themselves.

The 1956 Persons U.S. Pat. No. 2,739,811 shows a multiple person merry-go-round with a single crank connected to the center post to permit the riders to propel the merry-go-round.

The 1954 Taylor U.S. Pat. No. 2,680,616 shows a two person merry-go-round with pivoting handles connected to a single crank connected to the center post.

The 1958 Meyers U.S. Pat. No. 2,835,491 shows a two person merry-go-round with a single crank and a teeter totter action.

The 1965 Brookmane et al. U.S. Pat. No. 3,210,075 shows a two person merry-go-round with a lever driven ratchet drive mechanism to propel the unit.

The 1967 Jones U.S. Pat. No. 3,339,919 shows a four seat merry-go-round with a single crank having a light fixture located on the crank.

The 1973 Tada U.S. Pat. No. 3,758,108, shows a two person rotating seesaw that the riders propel with a single crank.

BRIEF SUMMARY OF THE INVENTION

Briefly, the present invention comprises a multiple seat merry-go-round with safety hand rails for riders who do not propel the merry-go-round and pivoting drive handles each connected to a center post with an offset crank with the offset cranks angularly positioned at less than 180 degrees from each other to insure that there are no dead spots that would render the pivoting drive handles ineffective in starting rotation of the merry-go-round.

DESCRIPTION OF THE PREFERRED EMBODIMENT

Figure 1:
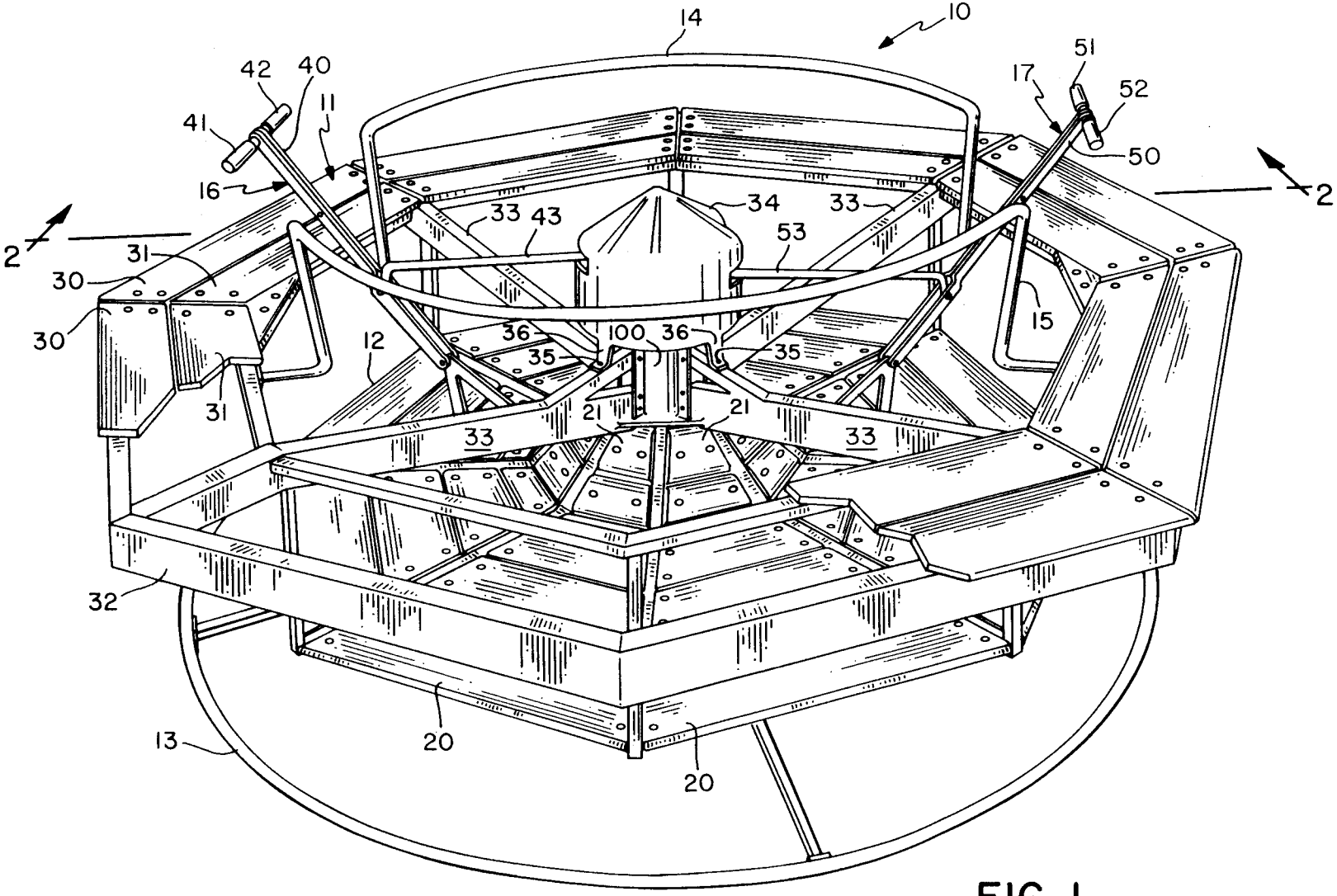
FIG. 1 shows a perspective view of my merry-go-round.
Figure 2:
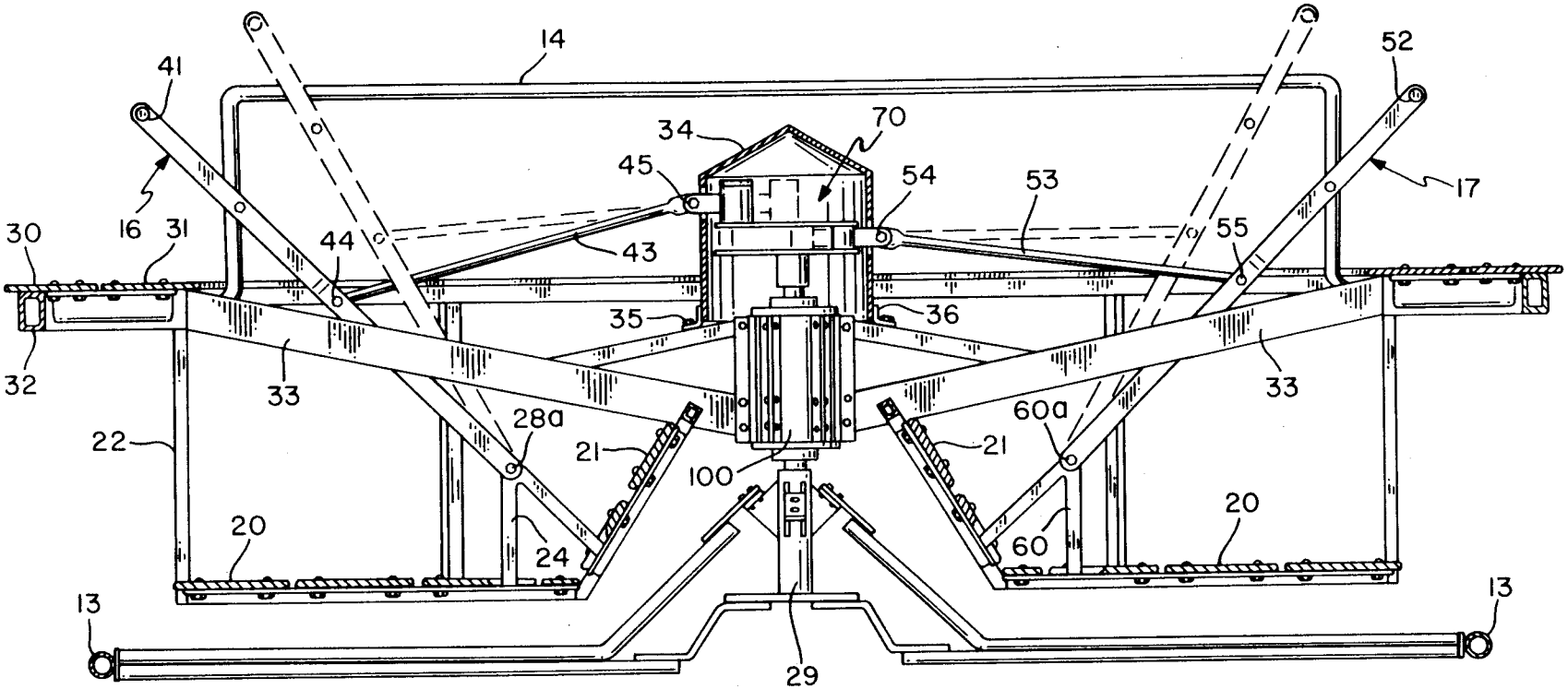
FIG. 2 shows a sectional view of my merry-go-round taken along lines 2—2 of FIG. 1.

Referring to FIG. 1 and FIG. 2 reference numeral 10 identifies my merry-go-round comprising an octagon shaped circumferential seating area 11, an octagon shaped foot support 12 located inward of the seating area, a support base 13, a first semi-circular shaped safety hand rail 14, a second oppositely disposed semi-circular shaped safety hand rail 15, a first pivoting handle 16 and a second pivoting handle 17 that when pivoted back and forth permit the riders to propel themselves in a circular motion around base 13.

Circumferential seating area 11 comprises a first set of outside seat boards 30 and an inner set of seat boards 31 that are located in an octagonal shape to permit children to sit on any circumferntial position along the circumferntial seating area of my merry-go-round. An octagonal shaped frame 32 supports the children's circumferntial seating area 11 in a cantilevered relationship with radial spokes 33 extending inward to a housing 100 that freely rotates about a stationary center post 29 that is connected to cylindrical base 13. Cylindrical base 13 is located concentric with post 29 and spaced inward of the circumferential so that if a child should fall off the merry-go-round the child would fall on the ground and not on cylindrical base 13.

In order to prevent the feet of the children from getting caught on the ground as my merry-go-round spins I include a horizontal positioned octagon shaped foot support 12 that is spaced inward of octagon seating area 11. To prevent the children's feet from getting entangled with the stationary center post 29 I provide a coaxially located center foot support 21. Foot support 20 is held in a spaced position from seating area 11 through circumferential spaced vertical struts 22 that attach to spokes 33. Similarly the center foot support 21 connects directly to the radial spokes 33 to provide foot supports that are coaxial and integrally connected to the children's circumferential seating area 11.

As the children sit on circumferential seating area 11 the two children sitting radially outward of handle 16 and 17 can pump the handles 16 and 17 back and forth to propel the merry-go-round. The other children who are riding can grasp hand rail 14 or 15 to hold themselves on my merry-go-round. The use of hand rails permits riders who may not have sufficient strength to propel the merry-go-round to ride while other stronger children can pump the merry-go-round.

To illustrate the pumping action of the handles 16 and 17 the pivoting propelling handles 16 and 17 are shown in solid and phantom positions in FIG. 2. FIGS. 1 and 2 show pivoting handle 16 has a first laterally extending hand grip 41 and a second laterally extending handgrip 42 to permit a child to grasp and apply force to pivot handle 16 about a pivot point **28*a* formed by A shaped support 24 that extends upward from foot supports 20 and 21. A connecting rod 43 pivotally connects to handle 16 through a pivot pin 44 with the other end of connecting rod pivotally connected to a crank mechanism 70, which is located beneath cone shaped safety shroud 34, by a pivot pin 45. Similarly, pivoting handle 17 has a first laterally extending handgrip 51 and a second laterally extending handgrip 52 to permit a child to grasp and apply force to pivot handle 17 about a pivot point 60*a* formed by A shaped support 60 that extends upward from foot supports 20 and 21. A connecting rod 53 pivotally connects to handle 17** through a pivot pin 55 with the other end of connecting rod pivotally connected to crank mechanism 70, which is located beneath cone shaped safety shroud 34, by a pivot pin 54.

FIG. 2 illustrates how the handles 16 and 17 can be pivoted to rotationaly engage crank mechanism 70 that is connected to stationary center post 29.

Figure 4:
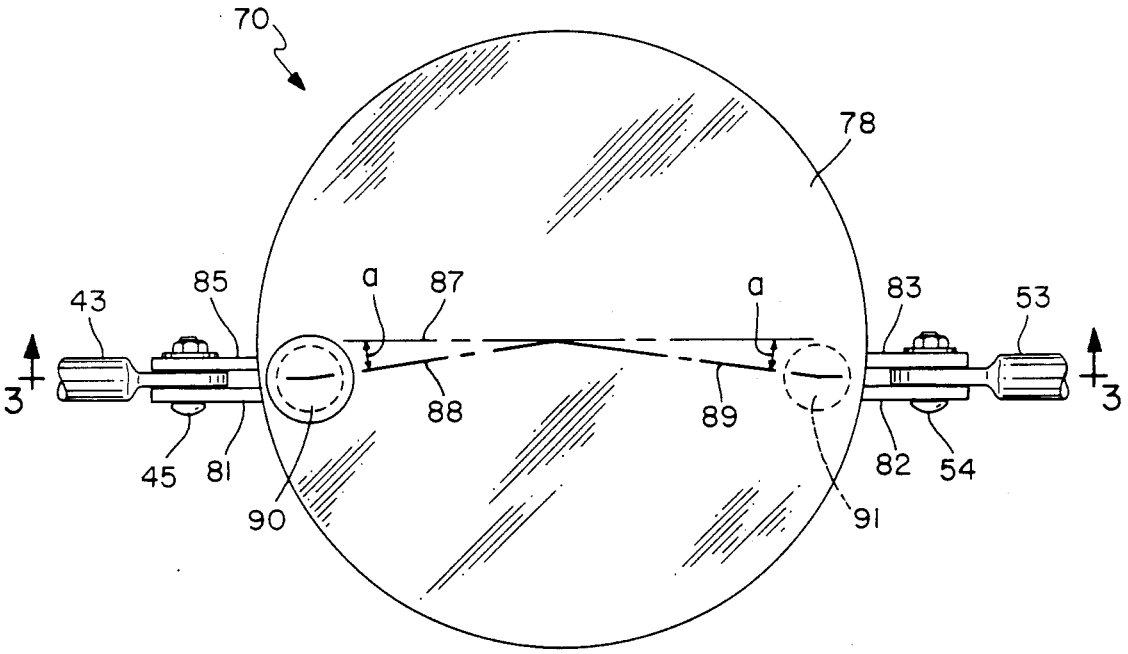
FIG. 4 shows a top view of double offset crank.
Figure 3:
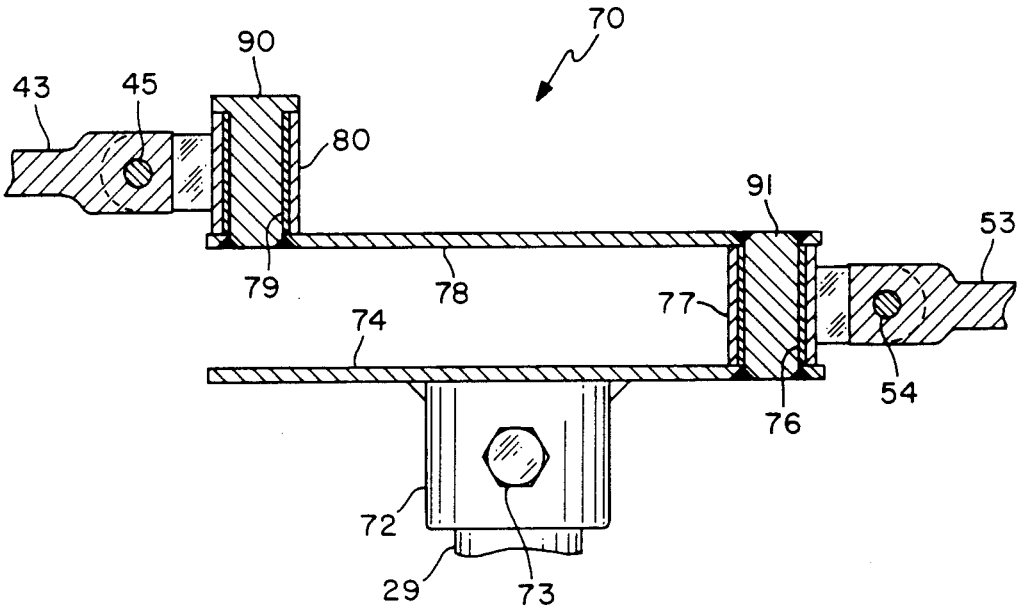
FIG. 3 shows a sectional view of my double offset crank for propelling my merry-go-round.

FIG. 3 and FIG. 4 show crank mechanism 70 in greater detail. Crank mechanism 70 comprises a pair of offset crank members that are attached to and spaced vertically above center post 29. Located on top of stationary center post 29 is a hub 72 that is connected to post 29 through a bolt 73. Coaxially attached to hub 73 is a first circular shaped plate 74 that has a single circumferential cylindrical spacing and connecting pin 91 welded to plate 74 and 78. Connecting pin 91 forms a crank pivot for connecting rod 53. Connecting pin 91 connects to and supports a second circular shaped plate 78 parallel to plate 74. Plate 78 is similarly located coaxially to center post 29. Center post 29, plate 74 and vertically extending pin 91 comprise the first crank that connects to pivot handle 17 through connecting link 53. Rotationally, connected to connecting pin 91 is a cylindrical housing 77 having a cylindrical wear bearing 76 located therein to form rotational engagement with connecting pin 91. A pair of parallel spaced members 82 and 83 connect to housing 77 to permit connecting rod 53 to pivot in a vertical plane about pivot pin 54 while housing 77 rotates about connecting pin 91 (FIG. 4).

Extending vertically upward from plate 78 is a similarly second circumferential located cylindrical pin 90 that is welded to plate 78. Pin 90 is located at the opposite side of center post 29 and parallel to pin 91. Pin 90 and plate 78 form a second crank that pivotally connects to connecting rod 43 of pivot handle 16 through a cylindrical housing 80. Cylindrical housing 80 forms rotational engagement with pin 90 through a cylindrical bearing 79. Connected to the outside of housing 80 are a pair of parallel spaced members 81 and 85. FIG. 4 shows pivot pin 45 extending through members 81, 85 and connecting rod 53 to permit connecting rod 43 to pivot in a vertical plane about pivot pin 45 as the children pull back and forth on handle 16 while bearing 79 permits rotational engagement of housing 79 with cylindrical pin 90. Thus each pivoting handle has a separate crank to propel the merry-go-round.

FIG. 4 shows my offset crank location provided by cylindrical pin 91 and cylindrical pin 90 which are not located on the major diameter 87 but are both positioned at an angle "a" from the major diameter 87. That is a line 88 through the center of pin 90 and the center of plate 78 forms an acute angle "a" of about 10 degrees with major diameter 87. Similarly, a line 89 extending through the center of pin 91 and the center of plate 78 also forms an acute angle "a" of about 10 degrees with major diameter 87. The use of two separate offset cranks with the pivot pins located at angle of less than 180 degrees from each other insures that at least one of the cranks will always be located so that the connecting rod, the center of the pivot pin and the center of the post will never be in alignment with one another. If the vertical plane through the connecting rod, the center of the pivot pin and the center of the post are in alignment with one another it produces a "dead spot" where inward or outwards force on the connecting rod does not provide any cranking action about center post 29. With the use of two offset cranks that are located at less than 180 degrees from one another it ensures that the two cranks are not on their respective dead spots at the same time. Consequently, the children can easily start my merry-go-round and do not have to push the merry-go-round to get it started.

I claim:

1. A merry-go-round for children to ride comprising:
   a support base;
   a center post extending vertically upward from said support base;
   a frame rotationally mounted to said center post, said frame including a circumferential seating area for children to sit on and a circumferential foot support to support the feet of the children above said support base, said frame including hand safety rails for riding children to grasp as the riding children sit on said circumferential seating area;
   a first crank mechanism having a dead spot and a second crank mechanism having a dead spot, said first crank mechanism and said second crank mechanism operable to permit children located on said seating area to rotational propel said frame about said center post, each of said crank mechanisms connected to a vertically pivoting handle that can be operated by a child sitting on said circumferential seating area, said first crank mechanism angularly offset by less than 180 degrees from said second crank mechanism so that at least one of said crank mechanism will not be in said crank mechanisms dead spot.

2. The merry-go-round of claim 1 including an octagonal shaped circumferential seating area.

3. The merry-go-round of claim 1 wherein said circumferential spaced foot support includes both horizontal and vertically extending foot supports.

4. The merry-go-round of claim 1 wherein each of said crank mechanisms comprises a pivoting handle having a connecting rod, said connecting rod pivotally connected to said pivoting handle, each of said crank mechanisms including a vertically extending pivot pin for rotationally engaging said center post.

5. The merry-go-round of claim 4 wherein said circumferential seating is located outside said base.

6. The merry-go-round of claim 5 wherein each of said crank mechanism includes a wear bearing.

7. The merry-go-round of claim 6 wherein said foot support includes a horizontal extending foot support and a vertically extending foot support.

8. The merry-go-round of claim 7 wherein said crank mechanism are offset about 10 degrees.

9. The merry-go-round of claim 8 including radial spokes wherein said circumferential seating area and said foot support are supported for rotation about said center post by said radial spokes.

10. A merry-go-round that can be started and propelled by children seated on the merry-go-round while other children ride the merry-go-round comprising:
   a support base;
   a center post extending vertically upward from said support base;
   a frame, said frame rotationally mounted on said center post;
   an annular shaped seating area and an annular shaped foot support located on said frame, said foot support extending below said annular shaped seating area to prevent the feet of children from getting caught on the ground or said frame as the merry-go-round spins around:

a first and a second semicircular shaped safety rails for riders on said merry-go-round to hold onto as said merry-go-round rotates about said center post;

a first plate said first plate having a center and a circumferential area, said center of said first plate connected to said center post;

a first pin connected to said circumferential area of said first plate, said first pin and said first plate forming a first crank with a dead spot;

a second plate located in a spaced parallel relationship to said first plate, said second plate having a center and a circumferential area, said first pin connecting said first plate to said second plate;

a central axis extending through said center post and said center of said first plate and said center of said second plate;

a second pin extending upward from said circumferential area of said second plate, said first pin and said second plate forming a second crank with a dead spot said first crank located above said second crank, said central axis, said first pin and said second pin positioned so as not to be in a straight line to thereby prevent said first crank from being located in said dead spot of said first crank when said second crank is located in said dead spot of said second crank;

a first handle pivotally mounted to said frame and said first crank to permit a first child on said merry-go-round to rotational propel said frame by applying a force to said first crank; and a second handle pivotally mounted to said frame and said second crank to permit a second child on said merry-go-round to rotational propel said frame by applying a force to said second crank so that the first child and the second child can start and propel said merry-go-round with riders on said merry-go-round.

11. The merry-go-round of claim 10 including a cone shaped safety shroud covering said first and said second crank.

* * * * *